US005402897A

United States Patent [19]

Garfinkle

[11] Patent Number: 5,402,897

[45] Date of Patent: Apr. 4, 1995

[54] TAG MOLDING SUPPORT

[76] Inventor: Benjamin L. Garfinkle, 1120 Portal Ave., Piedmont, Calif. 94610

[21] Appl. No.: 125,522

[22] Filed: Sep. 22, 1993

[51] Int. Cl.[6] ..... B42F 7/00

[52] U.S. Cl. ..... 211/59.1; 40/642; 211/57.1; 248/220.4

[58] Field of Search ..... 248/220.2, 220.4, 222.2; 211/59.1, 57.1; 40/642, 666

[56] References Cited

U.S. PATENT DOCUMENTS

| | | | |
|---|---|---|---|
| 4,463,510 | 8/1984 | Windish | 248/220.4 X |
| 4,540,093 | 9/1985 | Merl et al. | 248/220.4 X |
| 4,591,057 | 5/1986 | Garfinkle | 248/220.2 X |
| 4,665,639 | 5/1987 | Fast | 211/59.1 X |
| 5,088,606 | 2/1992 | Boas | 211/57.1 |
| 5,123,189 | 6/1992 | Fast et al. | 248/220.4 X |
| 5,235,766 | 8/1993 | Fast et al. | 40/642 X |

*Primary Examiner*—Ramon O. Ramirez
*Attorney, Agent, or Firm*—Malcolm B. Wittenberg

[57] ABSTRACT

An article support and display device for use with a support fixture. At least two spaced apart merchandise pegs are removably supported by the fixture at their proximal ends and have free distal ends for accepting and supporting merchandise for display. A baffle is provided in the form of a planar sheet material for residing over merchandise to be displayed and for supporting tag molding extending over the full width of the merchandise display.

16 Claims, 7 Drawing Sheets

TAG MOLDING SUPPORT

TECHNICAL FIELD OF THE INVENTION

The present invention deals with a device which is capable of supporting and displaying merchandise and related product identifying information within a supermarket or similar environment. The invention employs merchandise pegs and a baffle which supports molding for product identifying information. The present device can be employed using standard support fixtures which are commonly utilized in supermarket installations.

BACKGROUND OF THE INVENTION

The present invention relates to an article support and display apparatus for supporting articles of merchandise in display racks or cases and the like. Such displays are utilized in grocery stores and supermarkets and typically include peg bar support fixtures having apertures therein in which are removably inserted merchandise and molding support pegs for suspending and displaying merchandise for sale together with its product identifying information. Such devices are most common in refrigerator cases where luncheon meats and other prepackaged foods are displayed for sale although this is not the sole environment in which these devices can be found.

FIG. 1 depicts a typical article support and display device as described in U.S. Pat. No. 4,591,057. In employing such device, peg bar support fixture 1 having a substantially V-shaped cross-section is provided with cutout portions for releasably receiving molding support pegs 3 and merchandise support pegs 2. The molding support pegs being substantially S-shaped and having vertical extensions at their distal ends engage and support tag molding 4 through the use of slidable track clips. The molding support pegs 3 are provided in pairs for tag molding 4 which, in turn, are configured to slidably receive merchandise identification and pricing tags positionable proximate merchandise displayed for sale. The merchandise is, itself, supported on merchandise pegs 2 and, as shown in FIG. 1, tag molding 4 is positioned above and behind the distal ends of merchandise pegs 2 so that the merchandise offered for sale is not blocked from view by tag molding 4.

Yet another common iteration of a supermarket oriented merchandise display device is shown in FIG. 2. In this instance, a peg bar support fixture 5 is shown in the form of a tubular member having a substantially rectangular cross-section. Product identifying information is provided by a unitary molding support 6 which, at its proximal end, fits over support fixture 5 and, at its distal end, is provided with a turned-down section configured to receive product identifying information. As with the embodiment shown in FIG. 1, the display device of FIG. 2 is also intended to be provided with separate merchandise support pegs (not shown) which emanate from support member 5 below molding support 6. Obviously, hardware intended to be used with V-shaped peg bar support 1 cannot be employed with rectangular tubular member 5 of FIG. 2.

Although not depicted in any accompanying drawing, yet a further merchandise display device commonly employed in supermarket environments consist of a planar sheet of perf board having a regularly spaced array of holes configured therein. Merchandise support pegs and molding support pegs can be frictionally fit within holes contained in the perf board for product display. Again, such an arrangement is incompatible with the configurations shown in FIGS. 1 and 2 requiring different hardware and support apparatus in configuring an appropriate display.

It has also been found desirable to provide merchandise support and display installations of the type discussed herein with a baffle. A baffle is a shelf which can be employed generally above the merchandise being displayed, particularly when the display is found within a refrigerated supermarket dell case. The baffle is employed as an energy-saving device to aid in directing air flow within and about the refrigerated case in order to maintain the proper product temperature at a minimum of cost. When baffles are employed in installations such as those shown in FIGS. 1 and 2, a separate support configuration must be employed in addition to the merchandise and molding support pegs which does nothing but add to the cost and complexity of the installation. In addition, if product location were to change, one would generally be required to reposition the baffle which is something which store clerks often times neglect.

It is thus an object of the present invention to provide an article support and display device wherein product and molding supports can be universally applied to all support structures commonly found in supermarket installations.

It is yet a further object of the present invention to provide an article support and display device which includes energy directing baffle means without adding to the complexity of the structure so employed.

It is yet a further object of the present invention to provide an article support and display device wherein energy directing baffle means can be employed to eliminate the need for separate molding support devices traditionally found in prior art configurations.

These and further objects will be more readily appreciated when considering the following disclosure and appended drawings wherein.

SUMMARY OF THE INVENTION

An article support and display device is disclosed for use with a support fixture. The device comprises at least two spaced apart merchandise pegs, removably supported by said support fixture at their proximal ends. The merchandise pegs further are provided with free distal ends for accepting and supporting merchandise for display.

A baffle is provided which comprises a planar sheet material having proximal and distal edges while having a length proximate the distance between the spaced apart merchandise pegs and a width proximate the distance between the support fixture and the proximal ends of the merchandise pegs.

At least two adapters are provided for receiving the proximal edge of the baffle. The adapters are employed for releasably attaching the baffle to a suitable support fixture. Further, tag molding is provided which is attached to the distal edge of the baffle. The tag molding is provided with a track for receiving and displaying product identifying information.

DETAILED DESCRIPTION OF THE INVENTION

Figure 1:
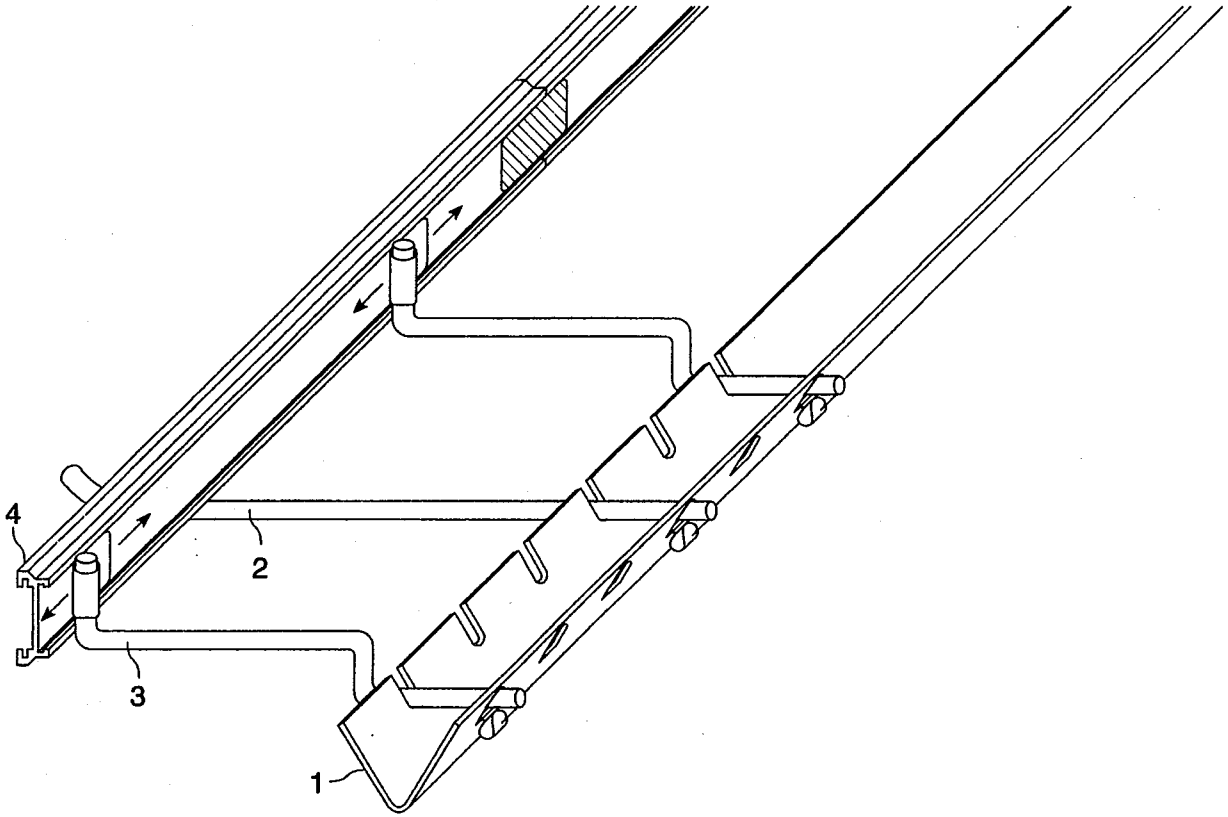
PRIOR ART FIG. 1
FIGS. 1 and 2 represent prior art as discussed above.
Figure 2:
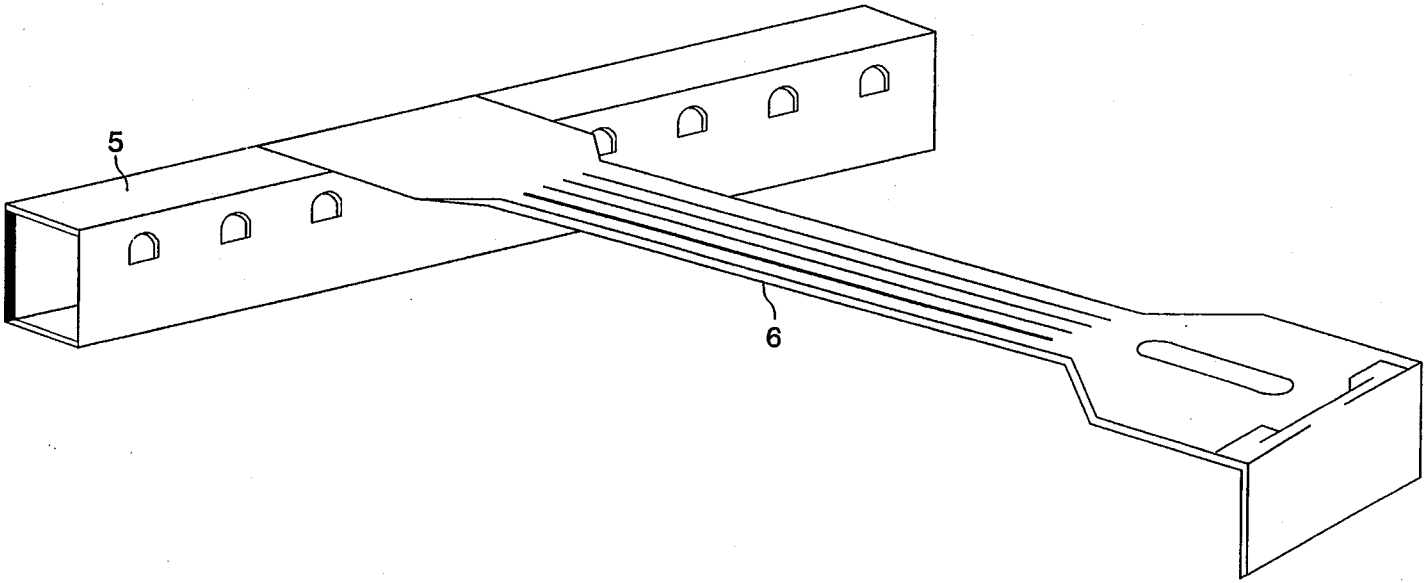
PRIOR ART FIG. 2
Figure 3:
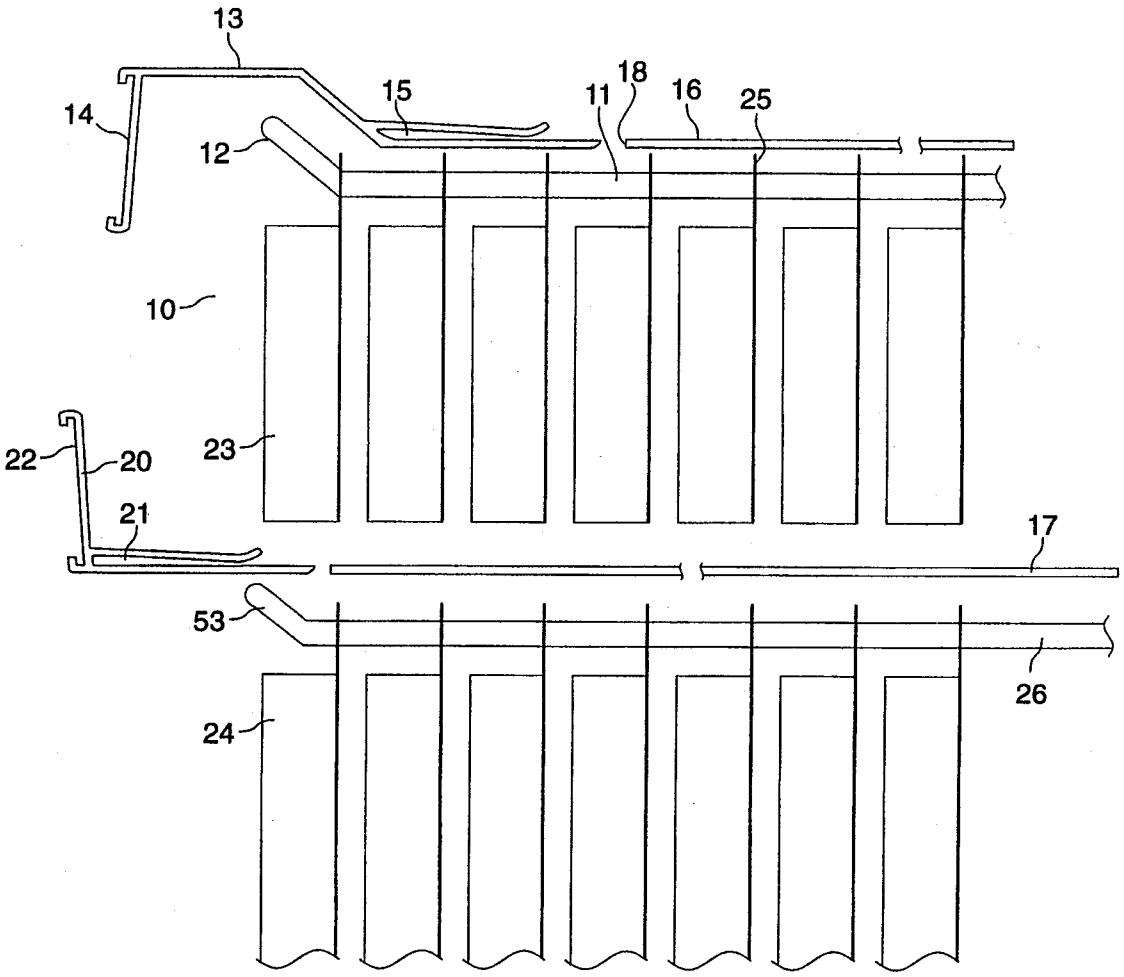
FIG. 3 is a side plan view of the article support and display device of the present invention in two different configurations.

The present invention can perhaps be most readily visualized when reference is made to FIG. 3. Although FIG. 3 does not show the commonly employed peg bar support fixtures, FIGS. 1 and 2 depict commonly employed support members for use therein.

Merchandise pegs 11 and 26 extend substantially horizontally from suitable peg bar support fixtures and are supported by them at their proximal ends although their distal ends 12 and 53 are slightly upturned for the receipt of generally prepackaged merchandise 23 and 24. The merchandise can be stacked along merchandise pegs 11 and 26 as shown for ready removal by consumers wishing to purchase such products.

Figure 9:
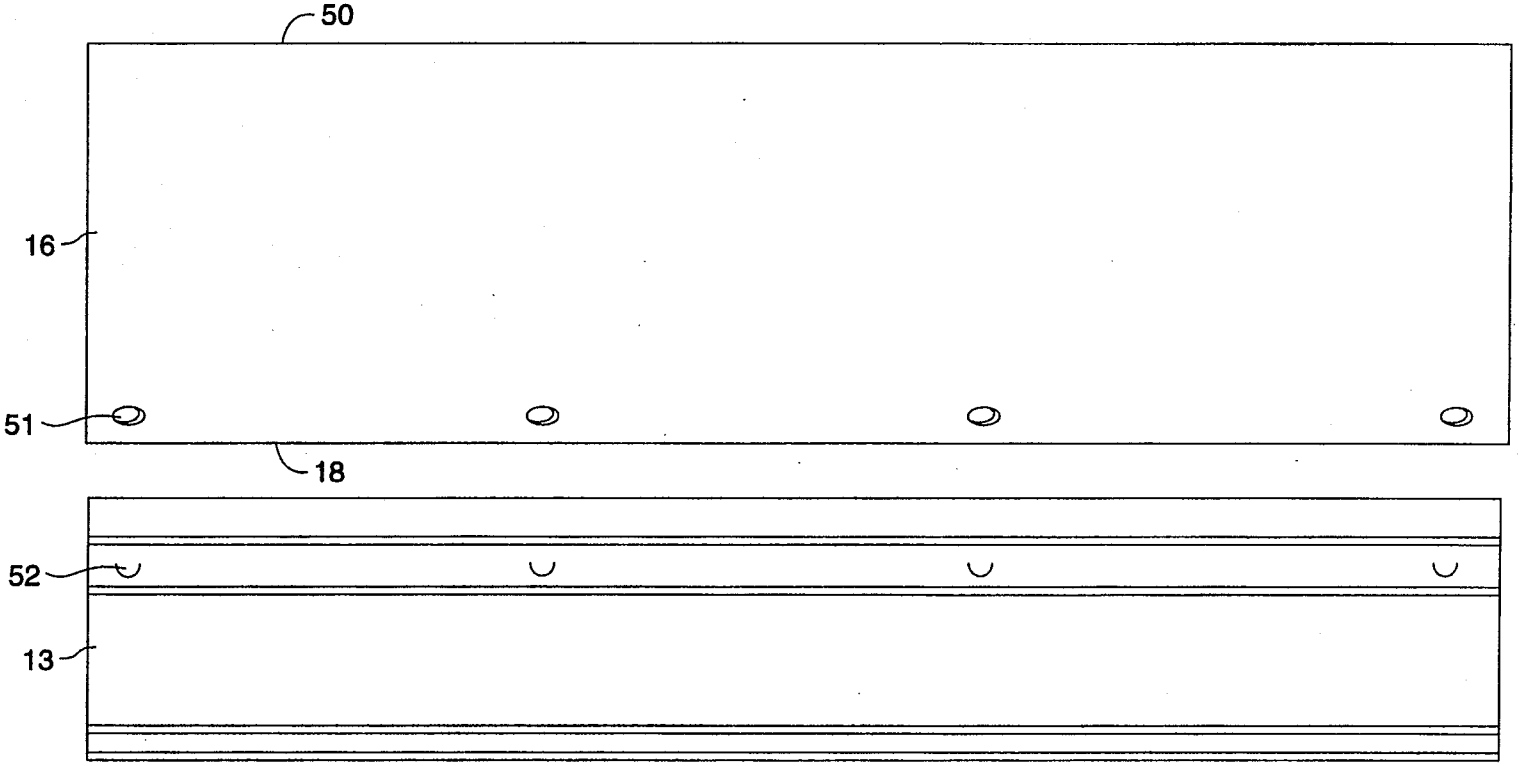
FIG. 9 is a top plan view of a typical baffle-tag molding for use herein.

Baffles 16 and 17 are generally configured of substantially transparent plastic sheets having distal edge 18 and proximal edge 50 (FIG. 9). Ideally, the baffles have a thickness of approximately 0.50 inches which allows for flexibility as the tag molding is lifted and yet is rugged enough to insure long life.

Baffle 16 is frictionally engagable by tag molding 13 at the distal edge 18 of said baffle. Baffle 16 is inserted within U-shaped track 15 of molding support 13 so that the molding support will resist inadvertent dislodgment from baffle 16 but which can be readily removed therefrom in the event that a change is deemed necessary by the display clerk. Upon installation, molding support 13 provides for channel 14 to receive product identifying information forward and above merchandise 23 as shown in FIG. 3.

Figure 8:
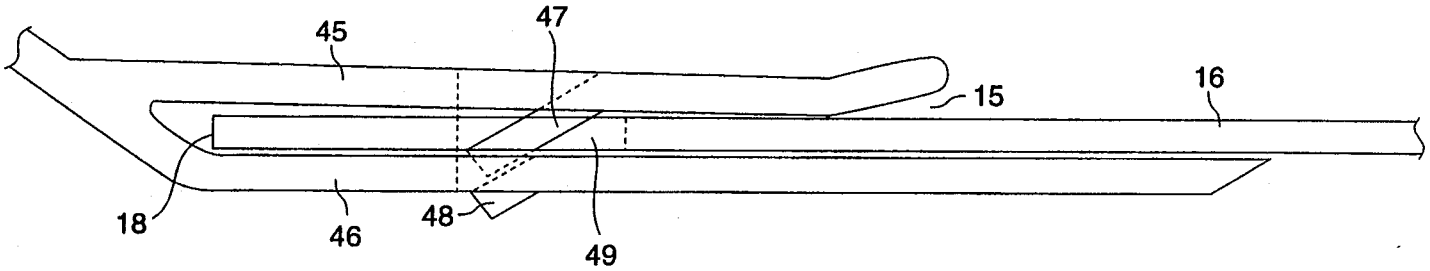
FIG. 8 is a side plan view illustrating the detail of the baffle/tag molding interface as a preferred embodiment.

As a preferred embodiment, various tab means can be provided within molding 13 as shown in FIG. 8. In this instance, locking tab 47 being a turn-down segment of upper leg 45 is caused to engage baffle 16 at mating aperture 49. At full locking engagement, locking tab 47 can cause reactive tab 48 to protrude below lower leg 46. This configuration will further prevent any unintentional removal of molding support 13 from baffle 16. Alternatively, baffle 16 and tag molding 13 are provided with the combination of indents 51 and protrusions 52 (FIG. 9) to again present inadvertent removal of the tag molding from the baffle.

Although not shown, a similar locking mechanism can be employed in maintaining tag molding 20 to distal end 19 of baffle 17. In this regard, baffle 17 is intended to engage tag molding 20 by frictionally engaging distal end 19 of baffle 17 within U-shaped molding tag extension 21. As noted, in reference to FIG. 3, tag molding 20 can be employed to present product identifying information within channel 22 either well above merchandise peg 26 or, alternatively, tag molding 20 can be employed below merchandise peg 11 for identifying product 23.

It is noted that tag molding 20 does provide for ease of product removal from a merchandise support peg, similar ease in restocking for the store clerk as well as providing an unobstructed view of the package label noting that the product name is usually found at the top of the package, As noted previously, baffles 16 and 17 are intended to be releasably attached to a suitable support fixture. Support fixtures are those typically employed in supermarket environments such as the V-shaped peg bar support 1 (FIG. 1), tubular member 5 (FIG. 2) as well as standard perf board configurations (not shown). As one embodiment, it is intended that the proximal end 50 of baffles 16 and 17 be frictionally engaged by a suitable adapter while the body of the baffle resides on and is somewhat supported by product 23 and 24 by, for example, its characteristic cardboard backing 25. Alternatively, the baffle can be made thick enough to reside over but not in contact with said displayed product.

Figure 4:
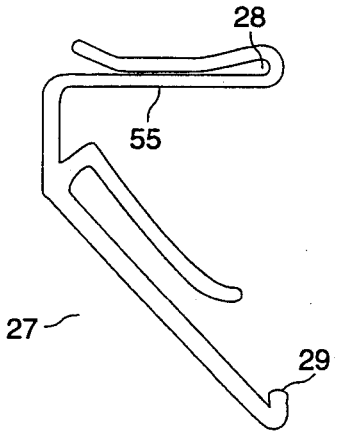
FIGS. 4, 5 and 6 are side plan views of various adapters useful in appending suitable baffle means to various commonly utilized peg bar or perf bar support structures.

The adapter of FIG. 4 is configured to releasably and frictionally engage V-shaped peg bar support 1 (FIG. 1). As such, adapter 27 is provided with hooked lip 29 which proceeds over and encompasses the apex of V-shaped member 1 such that top surface 55 maintains a substantially horizontal orientation so that baffle 16 can be frictionally received by U-shaped channel 28 found therein.

Figure 5:
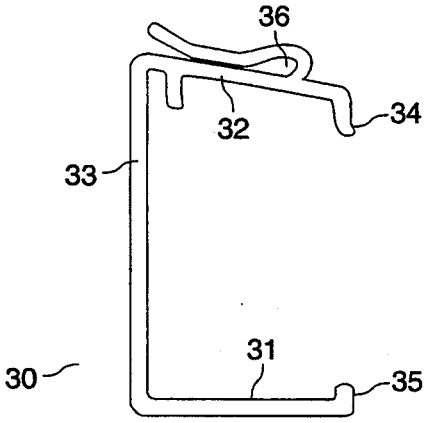

FIG. 5 is yet a further embodiment illustrating an adapter 30 for use with peg bar support 5. It is noted that peg bar support 5 is tubular in construction having a generally rectangular cross-section. As such, horizontal legs 31 and 32 in conjunction with vertical leg 33 of adapter 30 are intended to frictionally fit over and be retained on peg bar 5 making use of lips 34 and 35. Friction fit between adapter 30 and peg bar 5 substantially prevents inadvertent removal from the peg bar although intentional removal is straightforward by simply prying lips 34 and 35 from the rectangular cross-section of peg bar 5.

In operation, U-shaped section 36 is intended to frictionally receive the proximal end 50 of baffle 16. As a preferred embodiment, U-shaped element 36 can be provided with baffle 16 with an indent-protrusion combination in order to further prevent inadvertent removal of the baffle from its adapter.

Figure 6:
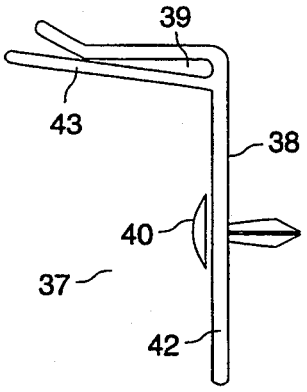
Figure 7:
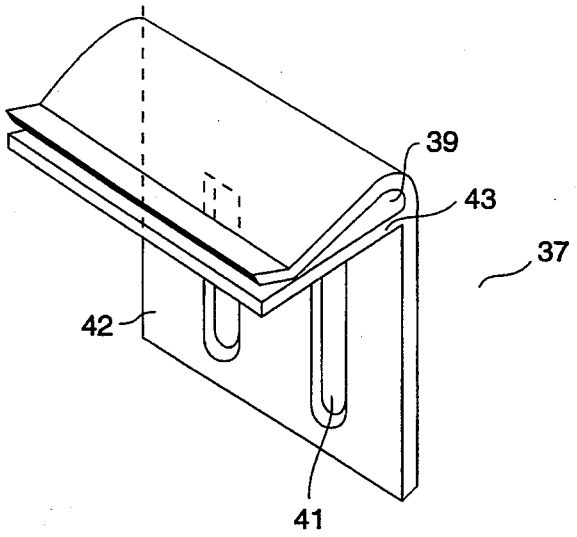
FIG. 7 is an isometric perspective view of the adapter of FIG. 6.

FIG. 6 and 7 illustrate yet a further embodiment of the present invention. In this instance, adapter 37 is provided for connecting baffle 16 to a standard perf board. Specifically, adapter 37 is provided with vertically extending leg 42 and horizontally extending leg 43 which meet substantially at a right angle forming an L-shaped cross-section. Slot means 41 are configured within the vertically extending leg 42 (FIG. 7) so that a connector such as rivet 40 can pass through slot 41 and extend within the opening found within a perf board (not shown). As such, flexibility in the placement of adapter 37 can conveniently be realized by enabling the adapter to vertically slide while being securely engaged by attachment means 40 to a standard perf board support. As in the case with the adapter discussed previously regarding FIGS. 4 and 5, the adapter of FIG. 6 is provided with U-shaped element 39 for receiving the proximal edge of baffle 16. It is noted that the present invention is not limited by any particular commonly available peg bar support structure. It is further not limited to the dell or refrigerated section of the supermarket. The present invention can be used in displaying such diverse items as packaged candy, Mexican spices and packaged nuts. In other words, it can be used anywhere that common sized packages are displayed on hooks.

It is also contemplated that baffles of various sizes be made available to the user of the present invention. The width of the baffle is a variable that allows price tag molding to emanate forward of the distal end of merchandise pegs. The length of the baffle generally extends the distance between the extreme merchandise pegs provided in the installation.

It is further noted that in light of the present configuration which enables the baffle to frictionally engage suitable adapter units, the adapters are capable of frictionally sliding across baffle edge 50 and thus can engage preexisting peg bar supports which adds to the flexibility of this invention.

I claim:

1. An article support and display device for use with a support fixture comprising at least two spaced apart merchandise pegs removably supported by said support fixture at their proximal ends and having free distal ends for accepting and supporting merchandise for display, a baffle comprising planar sheet material having proximal and distal edges and having a length greater than the distance between said spaced apart merchandise pegs and a width proximate the distance between said support fixture and distal ends of said merchandise pegs, at least two adapters for receiving the proximal edge of said baffle and for releasably attaching said baffle to said support fixture independently from the pegs, and tag molding attached to the distal edge of said baffle, said tag molding being provided with a track for receiving and displaying product identifying information.

2. The article support and display device of claim 1 wherein said baffle comprises a substantially transparent sheet of plastic.

3. The article support and display device of claim 1 wherein said adapters are sized to receive and frictionally engage said baffle at its proximal edge.

4. The article support and display device of claim 1 wherein said tag molding is sized to receive and frictionally engage said baffle at its distal edge.

5. The article support and display device of claim 1 wherein said tag molding is provided of a continuous length proximate the length of said baffle.

6. The article support and display device of claim 1 wherein said support fixture comprises a V-shaped peg bar support.

7. The article support and display device of claim 1 wherein said support fixture comprises a perf board support.

8. The article support and display device of claim 1 wherein said support fixture comprises a tubular member of substantially rectangular cross-section.

9. The article support and display device of claim 1 wherein said baffle is received by said adapters in such an orientation as to reside upon and be supported by merchandise retained by said merchandise pegs.

10. The article support and display device of claim 7 wherein said adapter is substantially L-shaped having two legs which meet substantially at a right angle, the first of said legs having open slot means for receiving a connector for passing through said slot means and being received by said perf board for attachment of said adapter thereto and a second of said legs having a U-shaped channel for frictionally receiving and supporting the proximal edge of said baffle.

11. The article support and display device of claim 8 wherein said adapter is substantially C-shaped having three legs, said three legs being sized to fit over and frictionally engage said tubular member said adapter having top and bottom substantially horizontally extending legs and a vertically extended leg being connected to said horizontally extended legs, the top horizontally extending leg including a lip forming a U-shaped channel for frictionally receiving and supporting the proximal edge of said baffle.

12. The article support and display device of claim 11 wherein at least one of said horizontally extending legs is provided with an indented edge to substantially prevent inadvertent removal of said adapter from said support fixture.

13. The article support and display device of claim 1 wherein said baffle is positioned above said merchandise pegs and said tag molding is positioned above and in front of the distal ends of said merchandise pegs.

14. The article support and display device of claim 1 wherein said baffle is positioned below said merchandise pegs and said tag molding is positioned in front of but below merchandise supported by said merchandise pegs.

15. The article support and display device of claim 4 wherein said tag molding and baffle are provided with at least one combination of indents and protrusions to prevent inadvertent removal of said tag molding from said baffle.

16. An article support and display device for use with a support fixture comprising at least two spaced apart merchandise pegs removably supported by said support fixture at their proximal ends and having free distal ends for accepting and supporting merchandise for display, a baffle comprising planar sheet material having proximal and distal edges and having a length greater than the distance between said spaced apart merchandise pegs and a width proximate the distance between said support fixture and distal ends of said merchandise pegs and at least two adapters for receiving the proximal edge of said baffle and for releasably attaching said baffle to said support fixture independently from the pegs.

* * * * *